US006234185B1

(12) United States Patent
Tidd

(10) Patent No.: US 6,234,185 B1
(45) Date of Patent: May 22, 2001

(54) UMBRELLA

(76) Inventor: Andrew M. Tidd, 25 Old Forge Rd., Helmetta, NJ (US) 08828

( * ) Notice: Subject to any disclaimer, the term of this patent is extended or adjusted under 35 U.S.C. 154(b) by 0 days.

(21) Appl. No.: 09/306,280

(22) Filed: May 6, 1999

(51) Int. Cl.[7] ..... A45B 25/14

(52) U.S. Cl. ..... 135/19.5; 135/22; 135/25.4; 135/33.6

(58) Field of Search ..... 135/15.1, 19.5, 135/22, 25.4, 25.41, 33.2, 34.2, 33.6

(56) References Cited

U.S. PATENT DOCUMENTS

| | | | | |
|---|---|---|---|---|
| 1,018,941 | | 2/1912 | Storm . | |
| 1,051,698 | | 1/1913 | Daggett . | |
| 2,172,549 | * | 9/1939 | Solomon | 135/20.2 |
| 2,492,376 | | 12/1949 | Brillas | 135/23 |
| 2,621,669 | | 12/1952 | Mayer | 135/20 |
| 2,621,670 | | 12/1952 | Woster | 135/22 |
| 2,654,380 | * | 10/1953 | Eichenbaum | 135/33.2 X |
| 3,053,266 | * | 9/1962 | Burns | 135/20.2 |
| 3,087,728 | * | 4/1963 | Pond, III | 273/67 |
| 3,177,883 | | 4/1965 | Militano | 135/26 |
| 3,446,221 | | 5/1969 | Truitt | 135/19.5 |
| 3,564,679 | | 2/1971 | Meyer | 29/25 |
| 4,061,154 | | 12/1977 | Cox et al. | 135/34 |
| 4,422,467 | | 12/1983 | Wu | 135/36 |
| 4,422,468 | | 12/1983 | Wilson | 135/97 |
| 4,597,400 | | 7/1986 | Trudeau, Sr. | 135/18 |
| 4,624,275 | * | 11/1986 | Baldwin | 135/19.5 |
| 4,821,756 | * | 4/1989 | England | 135/19.5 |
| 4,916,786 | | 4/1990 | Chollet et al. | 29/25 |
| 5,427,130 | | 6/1995 | Yang | 135/28 |

* cited by examiner

*Primary Examiner*—Carl D. Friedman
*Assistant Examiner*—Winnie Yip
(74) *Attorney, Agent, or Firm*—David L. Davis

(57) ABSTRACT

A disposable umbrella wherein the shaft and rib structure are of unitary molded plastic construction. The ribs are joined to a central hub attached to the shaft by a self-hinge having memory which causes the ribs to spring outwardly into a radially extending state when released from a collapsed state.

7 Claims, 2 Drawing Sheets

UMBRELLA

BACKGROUND OF THE INVENTION

This invention relates to umbrellas and, more particularly, to an umbrella which is of inexpensive molded plastic construction and adapted for one-time use and disposal.

People are often caught in a public place without an umbrella when the weather turns for the worse. Oftentimes, these people have one or more umbrellas at their home or office so they are loathe to spend a significant amount of money to purchase an additional umbrella. It would therefore be desirable to have an umbrella which can be manufactured and sold very inexpensively so that it can be used as a temporary umbrella and be disposed of after a single use.

It would also be desirable to provide such an umbrella which is of compact construction so that it can be sold through a vending machine.

SUMMARY OF THE INVENTION

According to the present invention, there is provided an umbrella which comprises a shaft and unitary rib structure. The shaft has first and second ends and the rib structure includes a central hub secured to the first end of the shaft and a plurality of substantially equiangularly spaced and equally long rib members extending radially outwardly from the central hub. The rib structure is molded of a plastic material and is relatively rigid except for the portions where the rib members are joined to the central hub. Each such joining portion is thinner than the remainder of each rib member to constitute a self-hinge where each rib member joins the central hub. This allows each rib member to be folded inwardly so as to be substantially parallel to the shaft with its distal end extending toward the second end of the shaft. Each self-hinge has memory so that when a rib member is released from its inwardly folded position it returns to a radially extending position. A membrane is secured to the plurality of rib members. Accordingly, the rib members can be folded about the respective self-hinges toward the shaft and thereafter held to place the umbrella in a collapsed state, and when the rib members are released they spring outwardly to return the umbrella to an extended state.

In accordance with an aspect of this invention, the rib structure is formed unitarily with the shaft.

In accordance with another aspect of this invention, the umbrella further includes a cover sleeve adapted to overlie the folded rib members and membrane to maintain the umbrella in the collapsed state.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
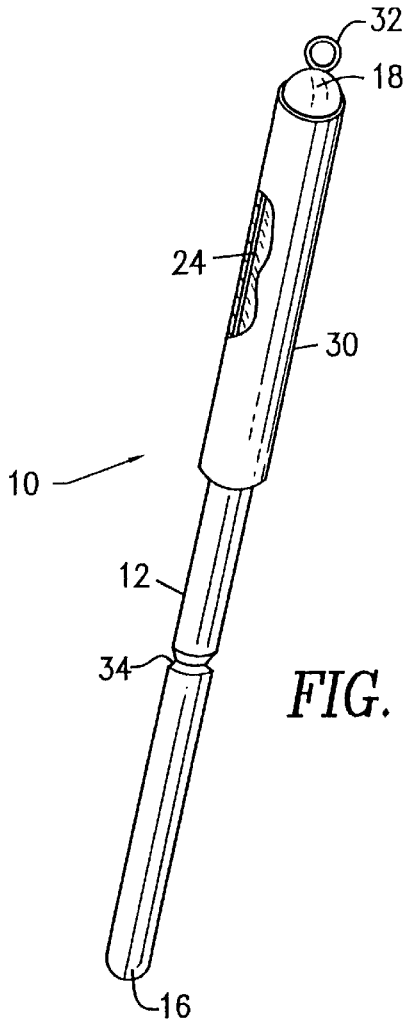
FIG. 1 is a perspective view, partially broken away, showing an umbrella constructed according to the present invention maintained in its collapsed state by a cover sleeve.
Figure 2:
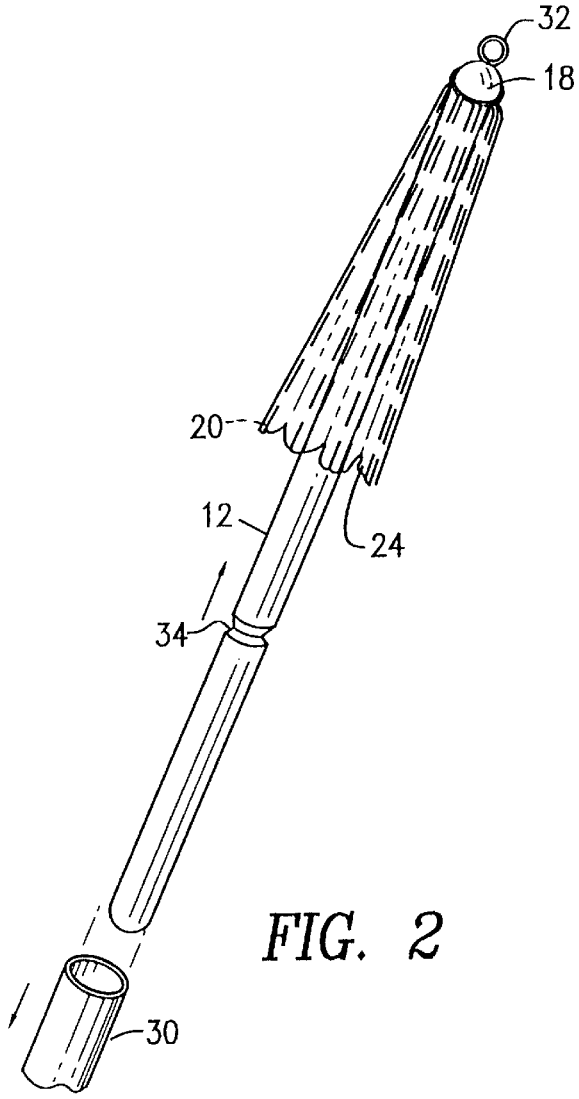
FIG. 2 shows the umbrella of FIG. 1 released from the cover sleeve prior to springing into its extended state.
Figure 3:
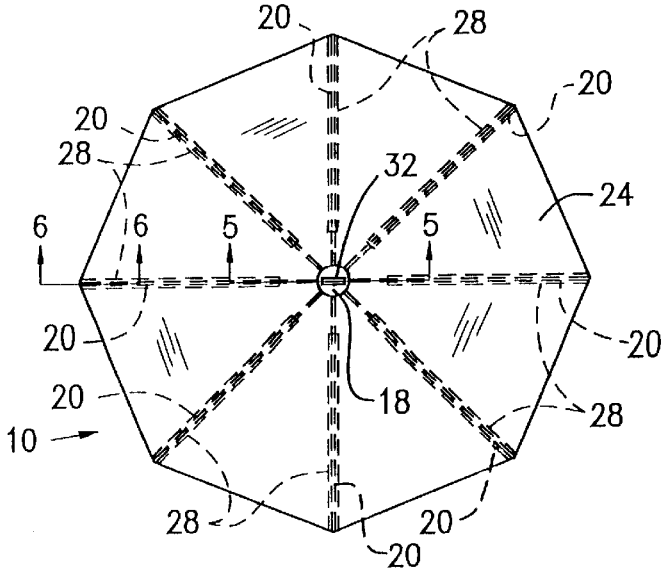
FIG. 3 is an end view showing the umbrella in its extended state.
Figure 4:
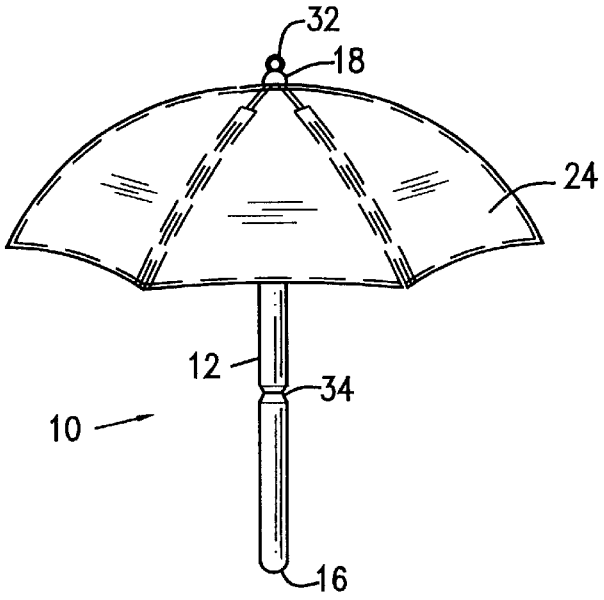
FIG. 4 is a side view showing the umbrella in its extended state.
Figure 5:
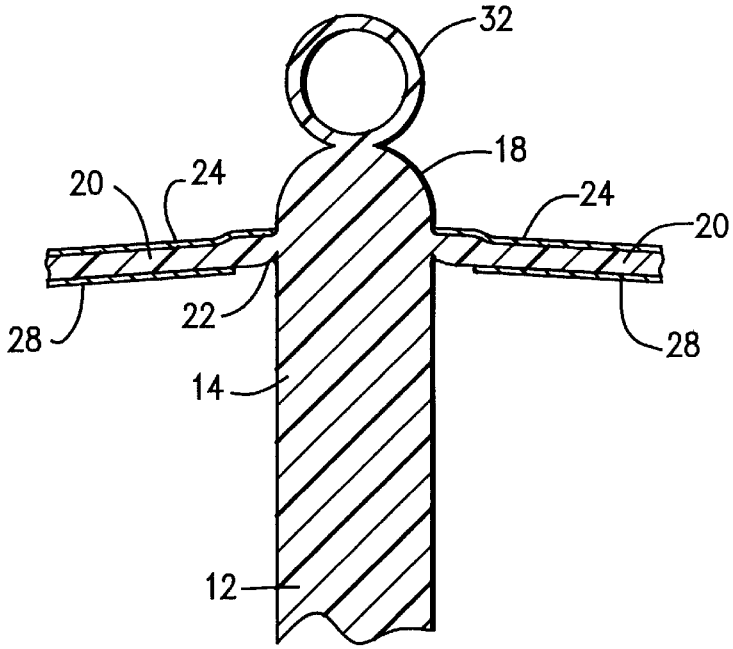
FIG. 5 is a sectional view taken along the line 5—5 of FIG. 3.

Referring now to the drawings, shown therein is an umbrella, designated generally by the reference numeral 10, constructed in accordance with the principles of this invention. The umbrella 10 includes a shaft 12 having a first end 14 and a second end 16 and further includes unitary rib structure having a central hub 18 secured to the first end 14 of the shaft 12. Illustratively, the central hub 18 is formed unitarily with the shaft 12, as best shown in FIG. 5, although the central hub 18 could be constructed as a disc secured to the shaft by a screw or the like. The rib structure further includes a plurality of substantially equiangularly spaced and equally long rib members 20 extending radially outwardly from the central hub 18. Preferably, the shaft 12, the central rub 18 and the rib members 20 are molded of a plastic material which is relatively rigid when cured.

As best shown in FIG. 5, the rib members 20 are of substantially uniform thickness so as to be relatively rigid except where each of the rib members 20 is joined to the central hub 18. At this juncture, each of the rib members 20 is made thinner, as by being undercut at 22, thereby forming a self-hinge. Accordingly, each of the rib members 20 can be folded inwardly about the self-hinge formed by the undercut 22 so as to be substantially parallel to the shaft 12 with its distal end extending toward the second end 16 of the shaft 12. As is known, each of the aforedescribed self-hinges has "memory" so that if a rib member 20 is folded about its self-hinge and then released, the rib member 20 returns to a radially extending position, as shown in FIG. 5.

Figure 6:
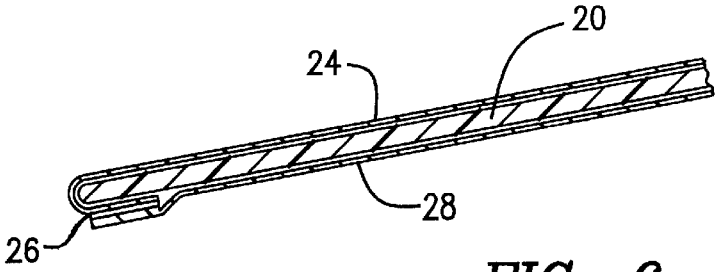
FIG. 6 is a sectional view taken along the line 6—6 of FIG. 3.

The umbrella 10 also includes a membrane 24 covering the rib members 20 on the side of the rib members 20 away from the shaft 12. The membrane 24 is formed with a central opening to fit over the central hub 18. To secure the membrane 24 to the rib members 20, the membrane 24 is folded about the distal end of each rib member 20 to form a hem 26 on the side of each rib member 20 toward the shaft 12, as best seen in FIG. 6. A plurality of elongated strips 28 of sheet material are provided, one for each of the rib members 20. Each strip 28 is secured to the hem 26, extends below a respective rib member 20, and is secured to the underside of the membrane 24 along opposite sides of the respective rib member 20. Accordingly, each strip 28, together with the membrane 24, forms an elongated pocket which allows relative sliding movement between the rib member 20 and the membrane 24. Preferably, the strips 28 and the membrane 24 are formed of the same plastic material and can be secured one to the other by any suitable means, such as, for example, by adhesive bonding, ultrasonic bonding, or the like.

To hold the umbrella 10 in its collapsed state, with the rib members 20 folded toward the shaft 12, a cover sleeve 30 is provided. The cover sleeve 30 is a tubular member and can be either rigid or flexible with a length that need be no longer than the length of the rib members 20. The cover sleeve 30 can also be relatively short, if desired, and is slipped over the collapsed umbrella 10 from the end having the central hub 18 in order to maintain the umbrella 10 in its collapsed state. Although the cover sleeve 30 is shown as being substantially as long as the rib members 20, it is understood that its desired function can be performed with a much shorter sleeve.

To assist in removing the umbrella 10 from the cover sleeve 30, a gripping member 32 is provided. The gripping member 32 is secured to the first end 14 of the shaft 12. Illustratively, the gripping member 32 is in the form of a ring formed unitarily with the central hub 18 and the shaft 12.

As discussed above, the umbrella 10 is designed for disposal after a single use. To assist in such disposal, the shaft 12 is formed with a weakened portion 34, illustratively in the form of a circumferential groove, so that the shaft 12 can be broken by snapping it at the groove 34.

Although in the drawings the shaft 12 is shown as being longer than the rib members 20, to provide a compact construction which is amenable to packaging for use in a vending machine, it is contemplated that the shaft 12 would have substantially the same length as the rib members 20.

Accordingly, there has been disclosed an umbrella of inexpensive molded plastic construction adapted for one-time use and disposal. While an illustrative embodiment of the present invention has been disclosed herein, it is understood that various adaptations and modifications to the disclosed embodiment are possible, and it is intended that this invention be limited only by the scope of the appended claims.

What is claimed is:

1. An umbrella comprising:

a shaft having first and second ends;

unitary rib structure including a central hub secured to said shaft first end and a plurality of substantially equally angularly spaced and equally long rib members extending radially outwardly from said central hub, said unitary rib structure being molded of a plastic material and being relatively rigid except for the portions where the rib members are joined to the central hub, each such portion being thinner than the remainder of each rib member to constitute a self-hinge where each rib member joins the central hub to allow each rib member to be folded inwardly to be substantially parallel to the shaft with its distal end extending toward the shaft second end, and each such self-hinge having memory so that when a rib member is released from an inwardly folded position it returns to a radially extending position; and a membrane secured to the plurality of rib members;

whereby the rib members can be folded about the respective self-hinges toward the shaft and thereafter held to place the umbrella in a collapsed state, and when the rib members are released they spring outwardly to return the umbrella to an extended state.

2. The umbrella according to claim 1 wherein said central hub of said rib structure is formed unitarily with said shaft.

3. The umbrella according to claim 1 further including a cover sleeve adapted to overlie the folded rib members and membrane to maintain the umbrella in the collapsed state.

4. The umbrella according to claim 1 wherein the membrane overlies the plurality of rib members on the side of each rib member away from the shaft and the membrane is folded about the distal end of each rib member to form a hem on the side of each rib member toward the shaft, the umbrella further comprising:

a plurality of elongated strips of sheet material each underlying a respective rib member on the side of the respective rib member toward the shaft, each strip being secured to the hem and to the membrane along opposite sides of the respective rib member to form an elongated pocket to allow relative sliding movement between the respective rib member and the membrane.

5. The umbrella according to claim 1 wherein said shaft includes a circumferential groove between its first and second ends to form a weakened portion;

whereby the shaft can be broken by snapping at the groove.

6. The umbrella according to claim 1 further comprising:

a gripping member secured to said shaft first end.

7. The umbrella according to claim 6 wherein said gripping member and said central hub of said rib structure are formed unitarily with said shaft.

* * * * *